US006434777B1

(12) United States Patent
Sutton

(10) Patent No.: US 6,434,777 B1
(45) Date of Patent: Aug. 20, 2002

(54) BRUSH FOR CLEANING GOLF EQUIPMENT

(76) Inventor: Wesley Raymond Sutton, 17 Northcliffe Road, Edithvale, Victoria 3196 (AU)

( * ) Notice: Subject to any disclaimer, the term of this patent is extended or adjusted under 35 U.S.C. 154(b) by 54 days.

(21) Appl. No.: 09/629,285

(22) Filed: Jul. 31, 2000

(30) Foreign Application Priority Data

Jul. 29, 1999 (AU) ..... PQ1896

(51) Int. Cl.[7] ..... A46B 5/00; A47L 13/12; A63B 57/00

(52) U.S. Cl. ..... 15/114; 15/118; 15/145; 15/176.1

(58) Field of Search ..... 15/114, 176.1–176.6, 15/194, 202, 145, 118

(56) References Cited

U.S. PATENT DOCUMENTS 2,205,535 A * 6/1940 Muckenhirn ..... 15/145
2,760,217 A * 8/1956 McKenzie ..... 15/176.3 X
3,034,165 A * 5/1962 Christian ..... 15/114 X
3,065,480 A * 11/1962 Sexton ..... 15/176.1 X
3,790,232 A * 2/1974 Alvarez ..... 15/145 X
4,831,678 A * 5/1989 Dietsche ..... 15/176.4
4,912,800 A * 4/1990 Zeltner ..... 15/114

* cited by examiner

*Primary Examiner*—Mark Spisich
(74) *Attorney, Agent, or Firm*—Welsh & Katz, Ltd.

(57) ABSTRACT

A brush 1 for cleaning golf equipment has a handle (2) and a head (3). A plurality of bristles (5) extend from the head (3). A first locking formation (6) is disposed on the handle (2) and a second locking formation (11) is disposed on the head (3). The first and second locking formations (6, 11) are of a complementary shape to engage to releasably lock the handle (2) and (3) together and clamp a cloth or towel (16) therebetween.

10 Claims, 3 Drawing Sheets

BRUSH FOR CLEANING GOLF EQUIPMENT

FIELD OF THE INVENTION

This invention relates to a brush for cleaning golf equipment. In particular, the invention relates to a brush for cleaning golf clubs and golf shoes.

BACKGROUND OF THE INVENTION

The striking surface of golf club heads and especially the grooves in the face frequently becomes soiled with dirt and grit during play. This can result in the club being less effective. The soles of golf shoes may also become soiled and dirty during the course of play.

One known form of cleaner for golf clubs consists of a brush that is carried in a golf bag pocket or in a player's pocket. Some brushes have a clip or other attaching device that permit them to be attached to a golf bag or golf buggy. Another form of cleaner for golf clubs consists of a sleeve having internal brushes that face towards each other. The blades of a club head are inserted into the sleeve between the brushes and the club head moved back and forth to remove and dirt or grit from the club head, including the striking surface. Alternatively, the sleeve may be moved back and forth along the club head.

One form of cleaner for the soles of golf shoes comprises a plate member having bristles mounted on the plate member. The cleaner is adapted to be clamped to a part of the frame of a golf cart or buggy. The sole of a golf shoe is scraped against the bristles of the cleaner, to remove dirt and grit.

The reference to any prior art in this specification is not, and should not be taken as, an acknowledgment or any form of suggestion that that prior art forms part of the common general knowledge in Australia.

OBJECT OF THE INVENTION

The object of the invention is to provide a brush for cleaning golf equipment.

SUMMARY OF THE INVENTION

According to one aspect of the invention there is a brush for cleaning golf equipment including a handle;

a head having a cleaning element;

a second locking formation disposed on the head;

the first and second locking formations being of complementary shape to initially engage with a reducible clearance between said first and second locking formations to accommodate the thickness of a cloth, said first and second locking formations being rotatable relative to each other from said initial engagement to reduce said clearance and clamp said cloth therebetween and releasably lock the handle and the head together.

The first locking formation may engage with the second locking formation in any suitable manner, for example, by sliding or rotation.

The first and second locking formations may adopt a variety of complementary cross sectional shapes.

The cleaning element can take the form of bristles or other formations integrally formed or formed of a separate material. Alternatively, the cleaning element can for example be a scouring pad or the like. In a preferred embodiment, the first locking formation comprises a stem and a flange. Preferably, the flange is rounded at opposing ends.

In a preferred embodiment, the second locking formation comprises a slot disposed in the surface of the head. Preferably, a channel is formed along on each side of the slot. The rounded ends of the flange are preferably of tapered thickness so that the flange wedges into locking engagement with the channel.

The configuration of the first and second locking formations can easily be interchanged so that the first locking formation comprises the slot while the second locking formation comprises the stem and flange.

The first locking formation may conveniently be integrally formed with the handle of the brush. The second locking formation may also conveniently be integrally formed with the head of the brush. The handle and head may have a generally cylindrical shape.

The cloth may be towel, rag or like article. The cloth may even be a piece of clothing if desired. In the preferred application the cloth is a golf towel. Golf towels are traditionally carried by golfers often in or attached to their golf bag or buggy. The towels are also used for cleaning of golf clubs so that it is particularly convenient to have the brush attached to the towel to enable the club to first be cleaned with the brush and subsequently wiped with the towel.

To assist in the understanding of the invention, a preferred embodiment of the will now be described with reference to the drawings.

DETAILED DESCRIPTION

Figure 1:
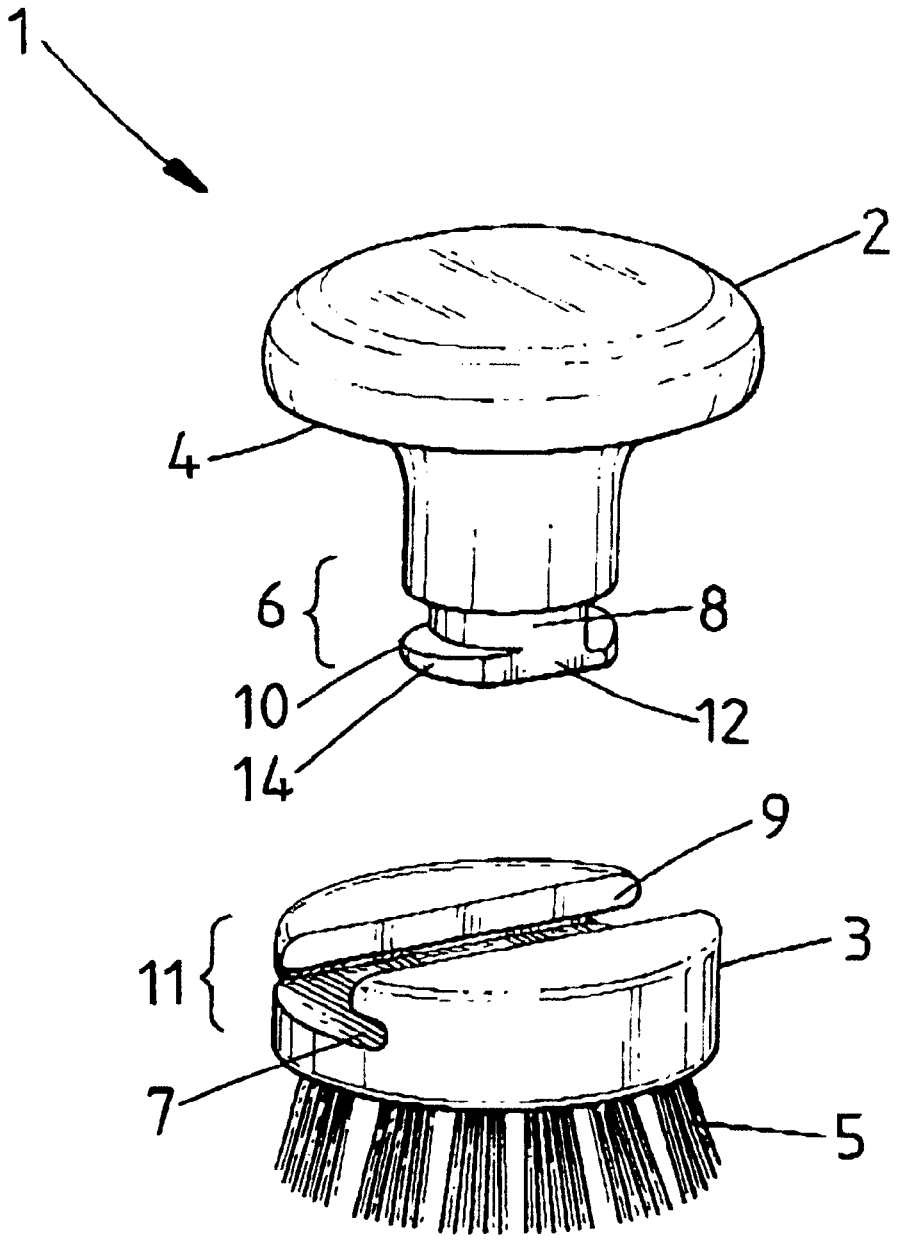
FIG. 1 is a perspective view of the brush according to the invention.

As shown in the drawings the brush 1 according to the invention is formed by two separate parts, a handle 2 and a head 3. The handle 2 and head 3 are cylindrical with a circular transverse cross section.

Figure 2:
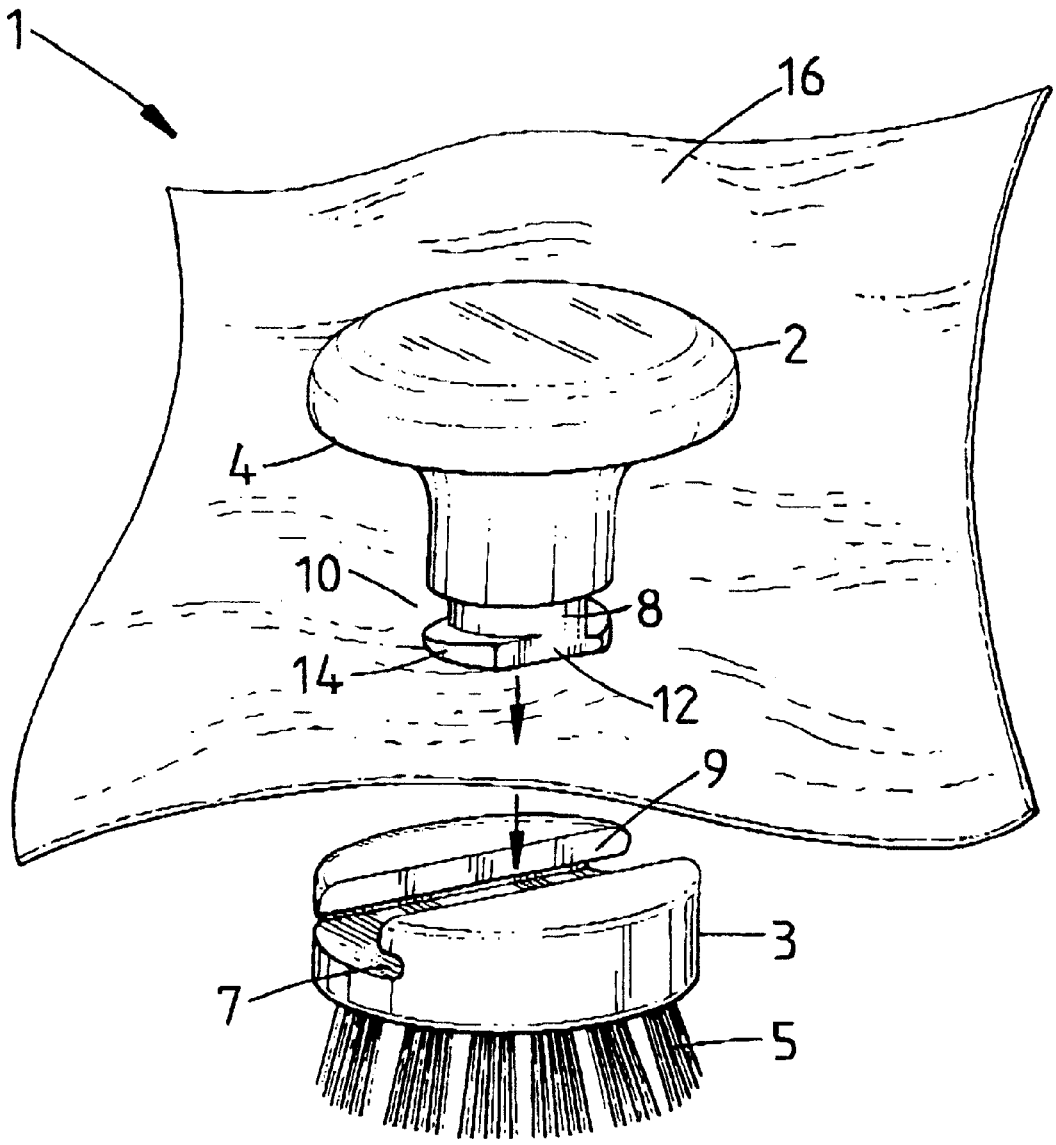
FIG. 2 is a view similar to FIG. 1 showing a towel positioned between the head and the handle.
Figure 3:
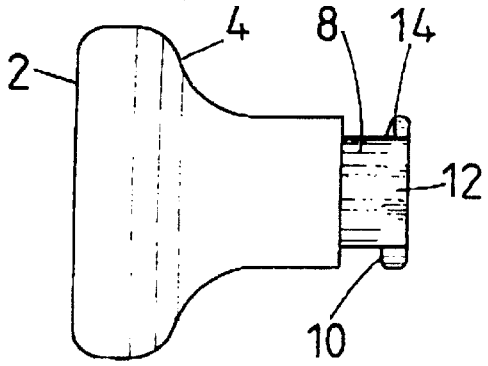
FIG. 3 is an elevation view of the handle of the brush.
Figure 4:
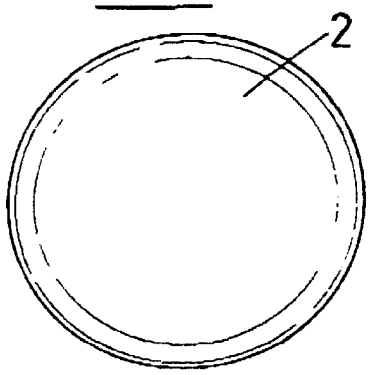
FIG. 4 is a left end view of the handle of FIG. 3.
Figure 5:
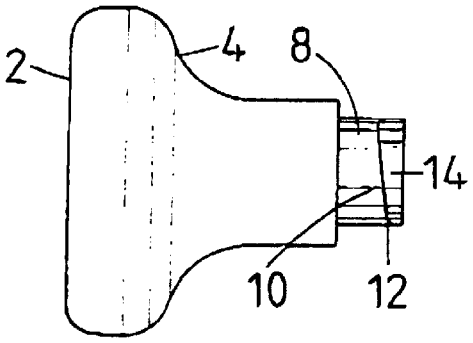
FIG. 5 is a plan view of the handle of FIG. 3.

The handle 2 is in the form of a knob 4 that tapers into a first locking formation 6, formed by a stem 8 and flange 10. As can be seen in FIGS. 2 and 3, the flange 10 has the same width as the stem 8 on one side. As seen in FIG. 5, the flange 10 has two parallel sides 12 and two rounded ends 14. The rounded ends 14 have a tapered thickness as best seen in FIGS. 3 and 5.

Figure 6:
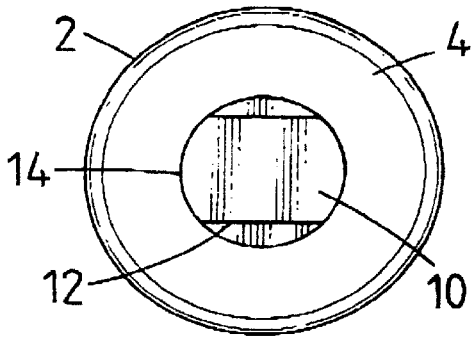
FIG. 6 is a right end view of the handle of FIG. 5.
Figure 7:
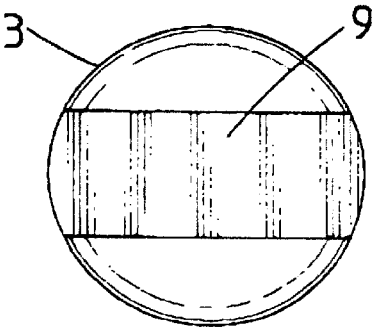
FIG. 7 is a end view of the head of the brush.
Figure 8:
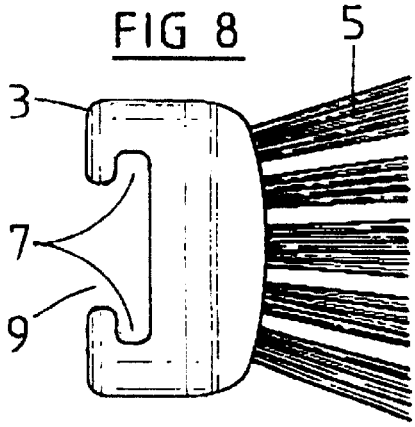
FIG. 8 is an elevation view of the head shown in FIG. 7.

FIGS. 6 and 7 illustrate the head 3 of the brush. The head 3 has a plurality of bristles 5 extending from one face of the head 3. The head 3 has second locking formation 11, formed by a slot 7 running along its centre, on the opposite face of the head 3. As shown in FIG. 7, the slot 7 is shaped so that an inwardly extending channel 9 is formed on each side of the slot 7.

The first and second locking formations 6, 11 have complementary profiles in a longitudinal cross section. This enables the engagement of the first and second locking formations 6, 11 during assembly of the brush 1. The flange 10 is dimensioned so that the two parallel sides 12 are separated by less than the width of the opening to slot 7. The rounded ends 14 are separated by more than the width of the opening to slot 7. This allows the flange to be inserted into slot 7 by orienting the parallel sides 12 parallel to the sides of the slot 7. The handle is then rotated so that the rounded ends 14 of flange 10 engage channels 9. The tapered thickness of the rounded ends 14 allow the rounded ends to wedge into locking engagement with channels 9. The first locking formation 6 and the second locking formation 11 provide sufficient space between the flange 10 and slot 7 to allow a golf towel 16 to be clamped between the handle 2 and head 3 via the flange 10 and slot 7, respectively.

In use, the brush 1 is assembled as follows. The handle 2 and head 3 are brought together on either side of a golf towel 16 (as shown in FIG. 2) so that the flange 10 lies within the groove 7 with the towel 16 sandwiched therebetween. The user then twists the handle 2 to cause the stem 8 and flange 10 to correspondingly rotate within the slot 7. This causes the flange 10 to rotate into engagement via the towel 16 with the channels 9 of the slot 7.

When the handle 2 has been twisted about 90°, the handle 2 and head 3 firmly locked together clamping the towel 16 between them. The tapering thickness of the rounded ends ensures that the flange 10 wedges into locking engagement with the channel 9.

Once assembled on the towel 16, the brush 1 may be conveniently used for cleaning golf clubs as required. As most, if not all, golfers have a cleaning towel attached to their golf bag or the buggy, the brush 1 may be conveniently clamped on the towel. The brush 1 is preferably located at a corner of the towel. In most cases the towel is used for final cleaning or wiping of the club head after the brush has been used to brush out dirt, grit or other soiled material from the club face.

The assembly of brush 1 as described above is convenient and easy to perform. In addition, the steps may easily be reversed to disassemble the brush 1 into its separate parts of the handle 2 and head 3. Thus, the brush 1 can be easily removed for washing or replacement of the towel.

The brush is preferably made of plastic which permits economical moulding of the separate handle and head of the brush.

The word "comprises", "comprising" and any variants thereof are intended to be used in its inclusive sense and in no way is intended to limit the features of the invention.

It is understood that various modifications, alterations, variations and additions to the construction and arrangement of the embodiment described herein are considered as falling within the ambit and scope of the present invention.

We claim:

1. A brush for cleaning golf equipment comprising a handle;

a head having a cleaning element;

a first locking formation disposed on the handle;

a second locking formation disposed on the head;

the first and second locking formations being of complementary shape to initially engage with a reducible clearance between said first and second locking formations to accommodate the thickness of a cloth, said first and second locking formations being rotatable relative to each other from said initial engagement to reduce said clearance and clamp said cloth therebetween and releasably lock the handle and the head together.

2. A brush according to claim 1 wherein the cleaning element includes a plurality of bristles extending from the head.

3. A brush according to claim 1, wherein one of the first and second locking formations has a stem and a flange.

4. A brush according to claim 3, wherein the flange is rounded at opposing ends.

5. A brush according to claim 3, wherein the opposed ends of the flange have a tapered thickness to facilitate wedging engagement of the first and second locking formations.

6. A brush according to claim 3, wherein the other of said first and second locking formations has a slot disposed in its surface.

7. A brush according to claim 6, wherein a channel is formed along each side of the slot.

8. A brush according to claim 1, wherein the first locking formation is integrally formed with the handle.

9. A brush according to claim 1, wherein the second locking formation is integrally formed with the head.

10. A combination of a cloth and a brush for cleaning golf equipment as claimed in claim 1.

* * * * *